US007938468B2

(12) United States Patent
Mueller

(10) Patent No.: US 7,938,468 B2
(45) **Date of Patent: *May 10, 2011**

(54) LIFTING SLING WITH EXCESSIVE ELONGATION WARNING INDICATOR

(76) Inventor: DeWayne Mueller, Jacksonville, FL (US)

( * ) Notice: Subject to any disclaimer, the term of this patent is extended or adjusted under 35 U.S.C. 154(b) by 274 days.

This patent is subject to a terminal disclaimer.

(21) Appl. No.: 12/231,971

(22) Filed: Sep. 8, 2008

(65) Prior Publication Data

US 2009/0015024 A1 Jan. 15, 2009

Related U.S. Application Data

(63) Continuation-in-part of application No. 11/368,142, filed on Mar. 3, 2006, now Pat. No. 7,422,256.

(51) Int. Cl.
*B66C 1/12* (2006.01)

(52) U.S. Cl. ..... 294/74; 73/862.56

(58) Field of Classification Search ..... 294/74, 294/907; 116/208, 212; 73/828, 862.53, 73/862.56, 852.56; 177/263
See application file for complete search history.

(56) References Cited

U.S. PATENT DOCUMENTS

| | | | | |
|---|---|---|---|---|
| 1,861,638 | A | 6/1932 | Martin | |
| 2,071,694 | A | 2/1937 | Howe | |
| 2,382,351 | A | 8/1945 | Thorpe | |
| 2,387,737 | A | 10/1945 | Black | |
| 2,393,053 | A | 1/1946 | Moore | |
| 3,463,534 | A | 8/1969 | Norton | |
| 3,466,080 | A | 9/1969 | Norton | |
| 3,572,091 | A | 3/1971 | McFarland | |
| 3,613,679 | A | 10/1971 | Bijou | |
| 3,926,227 | A | 12/1975 | Takada et al. | |
| 4,102,295 | A | 7/1978 | Crook, Jr. et al. | |
| 4,210,089 | A | 7/1980 | Lindahl | |
| 4,213,463 | A | 7/1980 | Osenkarski | |
| 4,245,512 | A | 1/1981 | Saunders | |
| 4,249,474 | A | 2/1981 | Archer | |
| 4,348,907 | A | 9/1982 | Giese | |
| 4,562,743 | A | 1/1986 | Bonine | |
| 4,757,719 | A | 7/1988 | Franke | |
| 4,850,629 | A | 7/1989 | St. Germain | |
| 4,958,853 | A | 9/1990 | Doty | |
| 4,992,778 | A | 2/1991 | McKeen et al. | |
| 5,195,950 | A | 3/1993 | Delannoy | |
| 5,333,509 | A | 8/1994 | Dimen | |
| 5,461,926 | A | 10/1995 | Bobb et al. | |
| 5,461,927 | A | 10/1995 | Bobb et al. | |
| 5,639,968 | A | 6/1997 | Bobb et al. | |
| 5,651,572 | A | 7/1997 | St. Germain | |
| 5,727,833 | A | 3/1998 | Coe | |
| 5,779,659 | A | 7/1998 | Allen | |
| 6,050,967 | A | 4/2000 | Walker et al. | |
| 6,152,893 | A | 11/2000 | Pigg et al. | |
| 6,422,624 | B1 | 7/2002 | Kauffman et al. | |
| 7,422,256 | B2 * | 9/2008 | Mueller | 294/74 |
| 7,681,934 | B2 * | 3/2010 | Harada et al. | 294/74 |
| 2006/0261617 | A1 | 11/2006 | St. Germain | |

* cited by examiner

*Primary Examiner* — Dean J Kramer
(74) *Attorney, Agent, or Firm* — Thomas C. Saitta

(57) ABSTRACT

A lifting sling having warning markings that indicate if the maximum safe load for the sling has been exceeded, whereby a visible indicator is provided to the operator at the time of overload. In an embodiment, a frangible indicator member connected to the cover of the lifting sling provide a permanent indication of sling overload.

19 Claims, 3 Drawing Sheets

LIFTING SLING WITH EXCESSIVE ELONGATION WARNING INDICATOR

This application is a continuation-in-part application of U.S. patent application Ser. No. 11/368,142, filed Mar. 3, 2006, which is now U.S. Pat. No. 7,422,256, issued Sep. 9, 2008.

BACKGROUND OF THE INVENTION

This invention relates generally to the field of lifting slings, and more particularly to the field of such slings having means to sense, measure, indicate or warn of excessive elongation, strain, tension or impending failure.

Lifting slings are devices similar to ropes, cables or chains that are used to lift large, heavy objects, typically with a crane or similar piece of equipment, with the sling being connected to or encircling the object and connected to a hook or similar attachment means on the crane. The lifting slings typically comprise one or more elongated bundles of fiber, thread or yarn forming a load-bearing core that is encased within a cover, jacket, sleeve, skein or the like. The fibers, yarns or threads are usually composed of a synthetic material, such as for example polyester or Kevlar, formed as multi-filaments or monofilaments, and they may be twisted or braided. The slings are typically of one of three types, either round (having the ends of the sling joined to each other to form a circle), flat web (having an elongated main body, the ends of which are bent back and secured to the body to form eyelets on each end), or eye-and-eye (a round sling enclosed with an elongated sleeve such that only relatively short loops extend from each end of the cover). Lifting slings are well known in the art, and examples are shown in U.S. Pat. No. 4,210,089 to Lindahl, U.S. Pat. No. 4,850,629 to St. Germain, and U.S. Pat. No. 5,727,833 to Coe.

Lifting slings are load rated so that the operator does not attempt to lift too great a weight for a given sling. It is typical, for example, for a sling to be load rated at one fifth of its failure strength, such that a sling that would fail under a load of 30,000 pounds would be load rated for safe operation for loads up to 6,000 pounds. It is quite common under real working conditions that the actual weight of objects being lifted is not known, and thus there may be many occasions where loads are lifted by a sling where unbeknownst to the operator the load exceeds the load rating of the sling. In addition, the tenacity or resistance-to-elongation of a sling is likely to increase over time, such that load weights significantly below the load rating may be unsafe and result in failure for slings that have been weakened by excessive use, undetected damage or environmental degradation.

All lifting slings elongate under heavy load to some degree, with slings made of polyester having greater elongation under load than a similarly rated sling composed of Kevlar or Aramid fibers. For example, a fourteen foot polyester sling load rated at 6,000 pounds may elongate up to five inches for a load approaching 6,000 pounds. Because elongation occurs under load, certain means for measuring or sensing the amount of elongation or any defects in continuity of the fiber core of a sling have been developed. Examples of such are shown in U.S. Pat. No. 4,757,719 to Franke, U.S. Pat. No. 5,651,572 to St. Germain, and U.s. Patent Publication No. 2006/0261617 to St. Germain, which disclose means comprising electrical circuits, optical fibers or exposed tell tails. Such systems may add significant costs to the slings and are subject to environmental degradation or operational damage.

It is an object of this invention to provide an elongation measuring or sensing means that provides an indication or warning to an operator that a load is approaching or exceeding the maximum safe load weight for a given sling. It is a further object to provide such a sling wherein the excessive elongation warning means is an integral component of the sling. It is a further object to provide such a sling wherein the excessive elongation warning means is relatively low cost, easily read and not readily susceptible to damage or degradation from environment or use. It is a further object to provide such a sling wherein the excessive elongation warning means is compatible with round, flat web or eye-and-eye slings. It is a further object to provide such a sling wherein excessive elongation results in permanent breakage of an indicator, and wherein the excessive elongation marking cannot be exposed unless the load has exceeded its maximum safe load.

SUMMARY OF THE INVENTION

The invention is a lifting sling of the type comprising one or more elongated bundles of synthetic fiber, threads, yarn or the like, provided in multi-filament or monofilament form, preferably twisted or braided, and encased within an elongated cover or jacket, the fiber bundles comprising the load bearing core of the sling. The lifting sling may be of any configuration, such as for example round, flat web or eye-on-eye.

Excessive elongation warning indicator means are provided, the dynamic indicator means comprising warning markings, indicia or other visible members that are disposed on, incorporated in, imprinted on or attached to the cover of the sling, and a static or stationary non-elongating body, housing or member that comprises demarcation means, such that the demarcation means references the markings in a visible manner, such that an observer may readily determine the extent of elongation of the sling and whether the sling is approaching or exceeding the maximum safe load. Preferably, the dynamic warning markings are non-uniform, having variations in color, size or content, such that certain markings indicate a safe load, other markings indicate a load approaching the maximum safe load, and still other markings indicate that the safe load has been exceeded. The static non-elongating body is affixed to the sling at a single location using suitable fastener means, such that relative motion between the load-bearing components of the sling and the non-elongating body occurs when the sling elongates under load. The demarcation means may include, for example, the non-affixed end of the non-elongating body, a slot, a window, a pointer, or similar structures.

In an alternative embodiment, a visible warning marker is disposed on the cover of the lifting sling and a frangible excessive load indicator member, such as a cable or wire, is extended in slack manner across the surface of the warning marker, the frangible indicator member being connected to a pair of web members affixed to the lifting sling cover and load bearing core. A first sleeve-like jacket member encircles the first web member, the lifting sling cover and the load bearing core, and is affixed to the lifting sling cover and load bearing core, the first jacket member terminating such that it does not cover the frangible indicator member. A second sleeve-like jacket member encircles the second web member, the frangible indicator, the lifting sling cover and the load bearing core, and is affixed to the second web member at or near the end of the second web member connected to the frangible indicator member. The second jacket member covers the frangible indicator and overlaps, or is overlapped by, the first jacket member in the passive and acceptable load bearing condition. In the event the load exceeds the sling load value, the sling cover and core elongate, the slack in the frangible indicator member is taken up and the frangible indicator member breaks, and the second jacket and the first jacket are pulled apart to expose the warning marker to the operator.

DETAILED DESCRIPTION OF THE INVENTION

With reference to the drawings, the invention will now be described in detail with regard for the best mode and the preferred embodiment. In general, the invention is a lifting sling that comprises indicator means to provide a visible warning to the operator when the elongation of the sling due to heavy load weight approaches or exceeds the maximum safe load rate for the sling.

Figure 1:
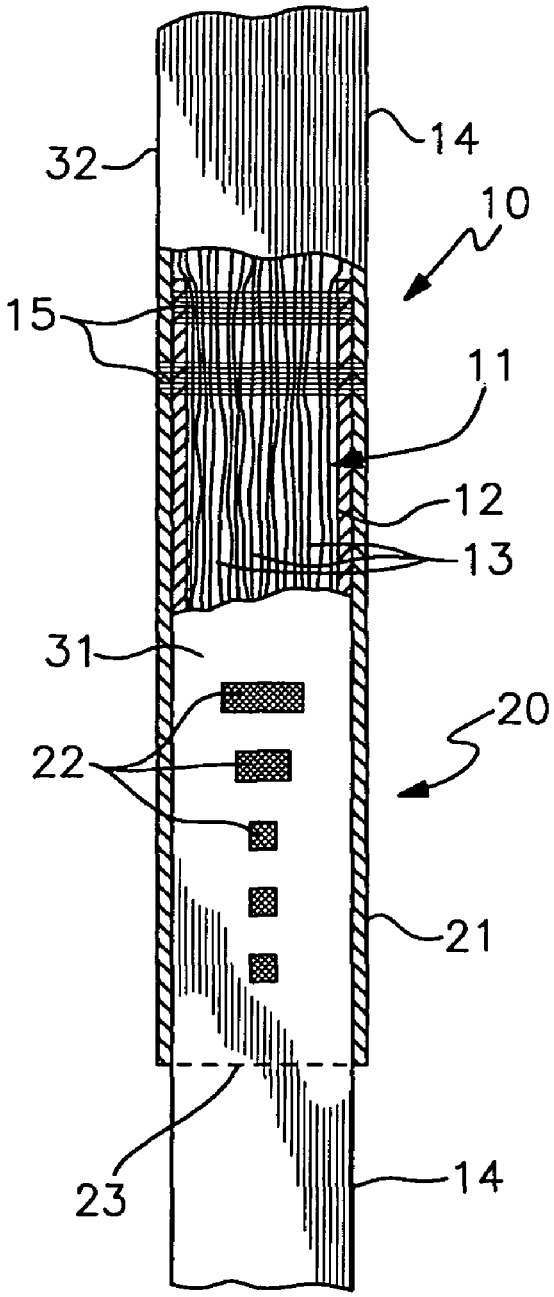
FIG. 1 is an exposed partial view of a round lifting sling in a non-load condition, such that the dynamic warning markings are concealed by the static non-elongating body of the excessive elongation warning indicator means, the non-elongating body comprising an extended portion of the sling cover.

As shown in FIG. 1, a representative lifting sling 10 comprises a load bearing core 11 formed of one or more extended fiber bundles 12 that are enclosed within an extended cover, jacket, skein, sleeve or the like 14. The fiber bundles 12 comprise fibers, threads, yarn or the like 13 most preferably composed of synthetic material such as polyester, Kevlar, Aramid or the like. The fibers 13 may be multi-filament or monofilament, and may be twisted, braided, interwoven or the like. While a sling 10 having a single core 11 is depicted in the drawings, it is to be understood that the sling of the invention may also comprise multiple cores 11. The round sling 10 depicted in FIG. 1 has a first end 31 disposed within a second end 32 in known manner and the cover 12 of the second end 32 is extended to receive the first end 31. The fiber bundle 12 is secured to the cover 14 both the first end 31 and the second end 32 by suitable bundle joining means 15, such as stitching, mechanical fasteners or the like. The load bearing core 11 and cover 14 are dynamic components of the sling 10, in that they will elongate to some degree when under heavy load.

Figure 2:
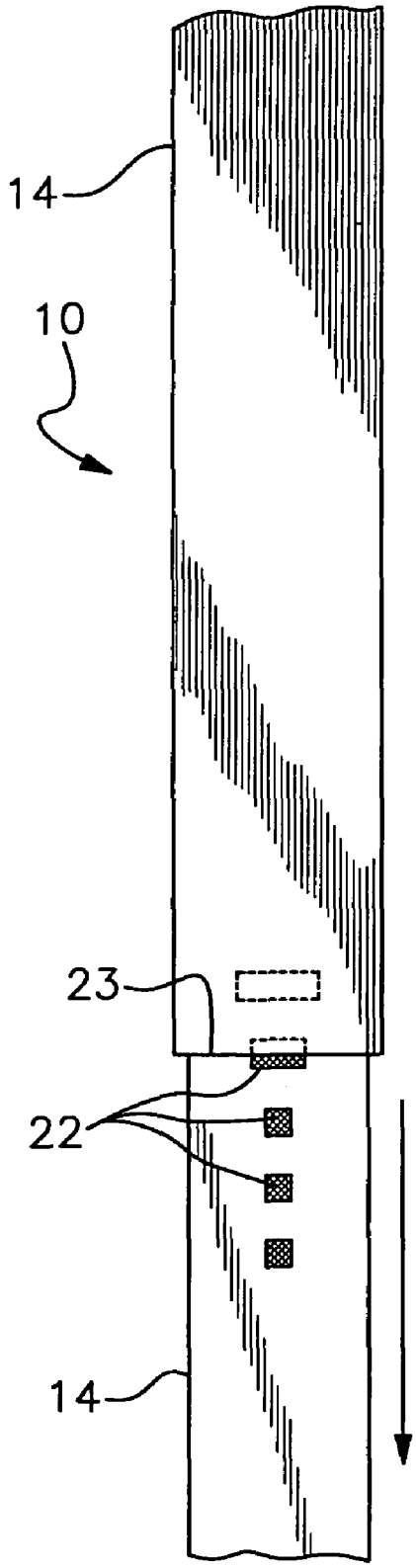
FIG. 2 is an external partial view of the lifting sling of FIG. 1 under a load condition that does not exceed the maximum safe load weight for the sling, showing exposure of the dynamic warning markings as the load-bearing components of the sling elongate under load.

In this embodiment as depicted in FIGS. 1 and 2, the excessive elongation warning indicator means 20 comprises a static non-elongating body 21 that is composed of the extended sleeve portion of cover 14 on the second end 32, and one or more dynamic warning markings, indicia or similar visible members 22 disposed on, imprinted upon, attached to or joined in suitable manner to the cover 14 adjacent the first end 31. The dynamic warning markings 22 may be of any shape or configuration, preferably being non-uniform for easier visual recognition, and may for example comprise similar shapes of changing dimensions, shapes of differing configurations, changes in color, wording such as "safe", "caution" and "overload", weight percents such as "20%", "40%", "60%", "80%" and "100%", etc., as long as the markings 22 provide suitable visible indication as to the extent of elongation of the sling 10 relative to its maximum safe load weight. The indicator means 20 further comprises static demarcation means 23 to reference a particular warning marking 22, with the demarcation means 23 comprising an edge, end, line, pointer or similar means to designate the marking 22 corresponding to the extent of elongation of the sling 10. In FIGS. 1 and 2, the demarcation means 23 is simply the end of the static non-elongating body 21. The warning markings 22 are dynamic in the sense that they move relative to the static demarcation means 23. The separation distance between the individual warning markings 22 may remain the same, such as when a non-elongating material is affixed to the cover 14, or may increase due to elongation under load, such as when the warning markings 22 are imprinted directly on the cover 14. Some, all or none of the warning markings 22 may be covered by the non-elongating body 21 and/or exposed by the demarcation means 23. Preferably, the warning marking 22 indicating that the load rating has been exceeded remains covered by the non-elongating body 21 until that condition is reached.

As shown in FIG. 2, which depicts a typical load condition wherein the sling 10 is elongated under the weight of the object being lifted, the static non-elongating body 21 remains of unchanged dimension even with the sling loaded, since the indicator means body 21 and the demarcation means 23, here the free end of the non-elongating body 21, are only fixed to the sling 10 by fastener means 24 at one location and are not load bearing components. In other words, relative motion occurs between the dynamic components, cover 14 containing the markings 22, and the static components, non-elongating body 21 and demarcation means 23. As the sling 10 elongates under load, the cover 14 elongates such that some or all of the warning markings 22 are moved into an exposed position beyond the demarcation means 23. As depicted in FIG. 2, the sling 10 has elongated under load such that the maximum safe load weight is being approached but not exceeded, since the maximum load warning marking 22, shown as the longest of the bars, is not exposed.

Figure 3:
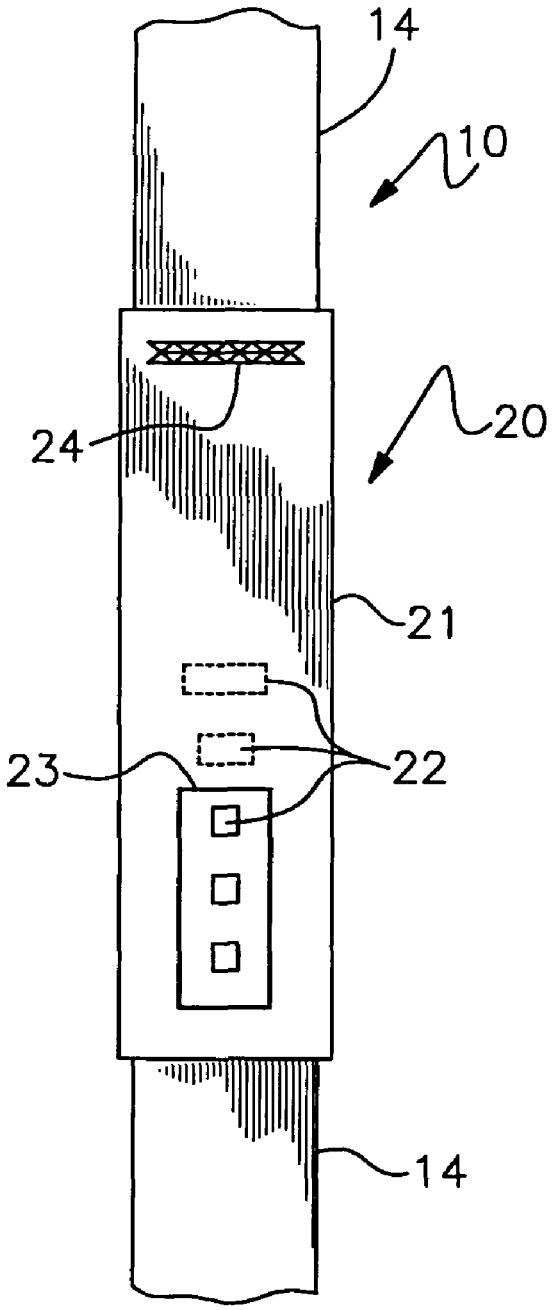
FIG. 3 is a partial view of a lifting sling of any type in a non-load condition showing the static non-elongating body as being an added member affixed to the sling cover, the demarcation means of the excessive elongation warning indictor means comprising a window or slot disposed in the body.
Figure 4:
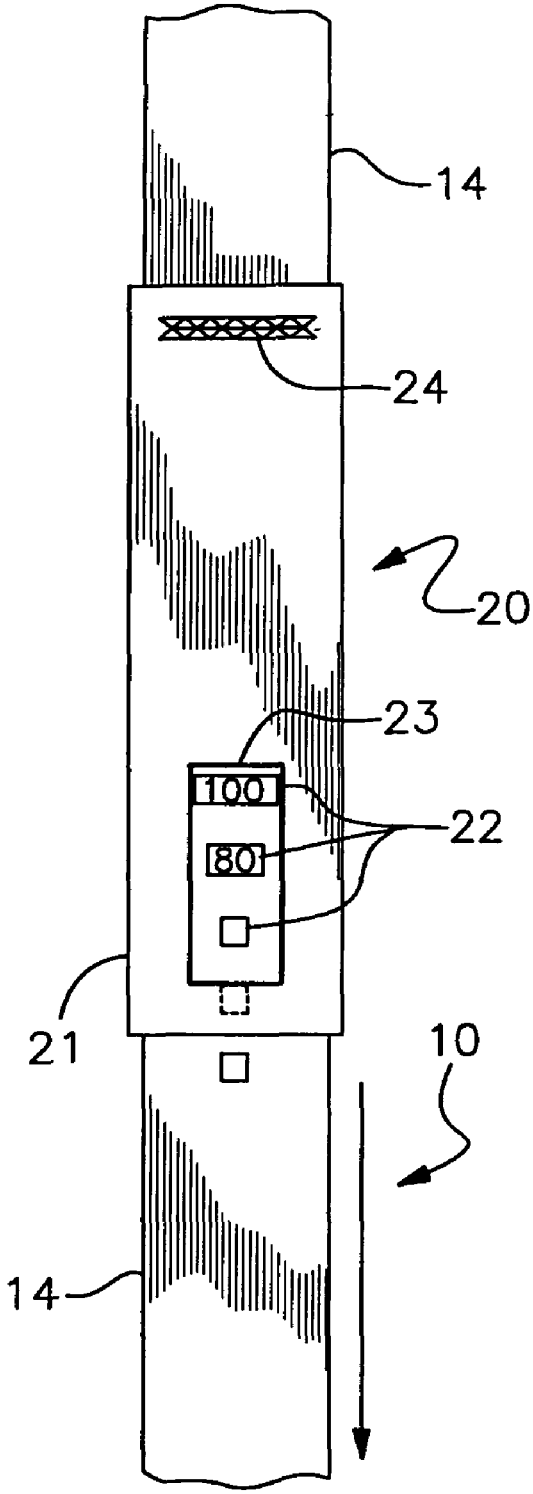
FIG. 4 is a partial view of the lifting sling of FIG. 3 under a load condition that exceeds the maximum load weight for the sling.

An alternative embodiment for the invention is shown in FIGS. 3 and 4, which may comprise a round, flat web or eye-on-eye sling 10. In this embodiment, the excessive-elongation warning indicator means 20 comprises a static non-elongating body 21, such as a tubular member, that is affixed by fastener means 24 to the dynamic cover 14 of the sling 10. Such excessive elongation warning indicator means 20 could also be a post-manufacture addition to slings already in use. In this embodiment, the demarcation means 23 comprises a slot or window, such that the warning markings 22 are visible therethrough. When the sling 10 is under load, as shown in FIG. 4, the cover 14 elongates and the position of the warning markings 22 relative to the demarcation means 23 changes. In this depiction, 100% of the maximum safe load weight has been reached and is indicated by visible exposure of the "100" warning marking 22, and the operator should either lighten the load or switch to a higher rated sling.

The separation distances of the warning markings 22 on the dynamic load bearing components of the lifting sling 10 will vary depending on the material components of the sling 10, primarily that of the load bearing core 11, since different materials will have different elongation amounts under the same load. More than one excessive elongation warning indicator means 20 may be provided on a single sling 10.

Figure 6:
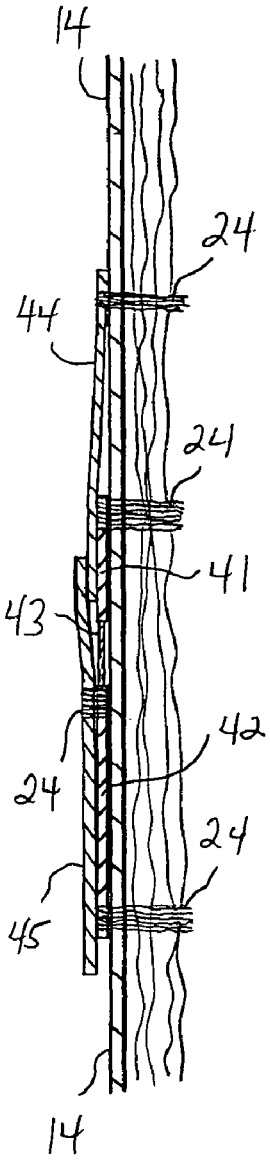
FIG. 6 is a partial cross-sectional view of the embodiment shown in FIG. 5.
Figure 5:
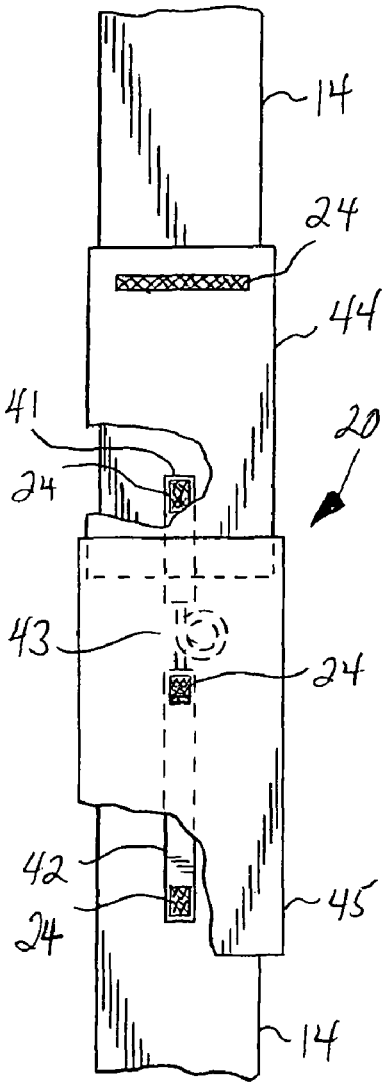
FIG. 5 is an exposed partial view of an alternative embodiment of the invention showing the lifting sling in the passive or acceptable load state.
Figure 7:
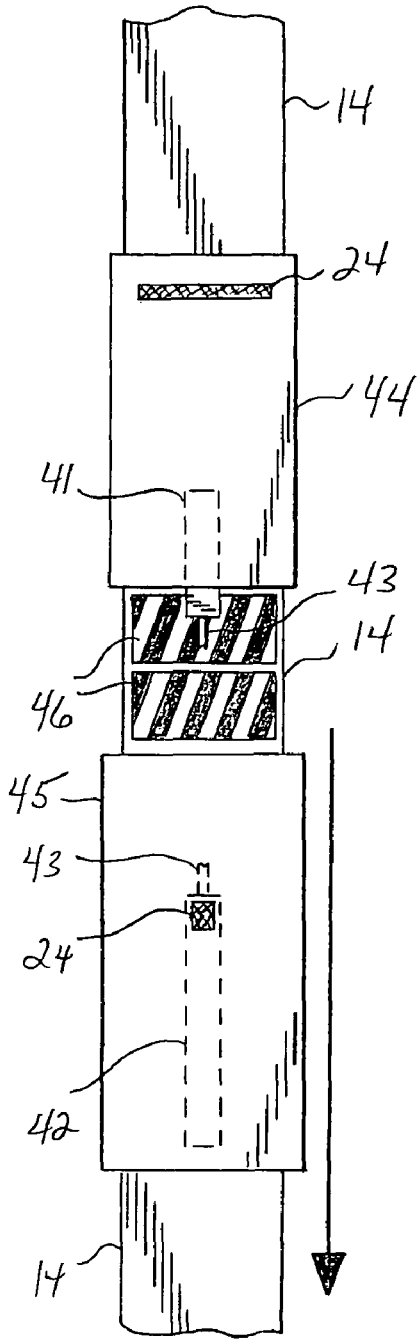
FIG. 7 is a partial view of the embodiment shown in FIG. 5, showing the lifting sling in an excessive load state.

In an alternative embodiment illustrated in FIGS. 5 through 7 and showing an alternative elongation warning indicator means 20, a visible warning marker 46 is disposed on the lifting sling cover 14, such as by attachment through stitching, bonding or the like, direct imprinting, etc. A frangible excessive load indicator member 43, such as a cable or wire, having a known and relatively low tensile breaking strength, is extended in slack manner across the surface of the warning marker 46, the frangible indicator member 43 being connected to a first web member 41 and a second web member 42, such as for example straps, affixed to the lifting sling cover 14 and load bearing core 11 by suitable fastener means 24, such as by stitching. Preferably, the second web member 42 is longer than the first web member 41, and the end of the second web member 42 not directly connected to the frangible indicator member 43, i.e., its distal end, is affixed to the lifting sling cover 14 and load bearing core 11. The length of the frangible indicator member 43 is chosen such that upon the lifting sling 10 being exposed to a load in excess of its maximum safe load weight, the slack in the frangible indicator member 43 will be taken up and the frangible indicator member 43 will break. This is determined by subjecting the lifting sling 14 to a load at or near its maximum safe load and measuring the amount of elongation inherent in the sling 14. For example, if upon testing an elongation of six inches is found to be acceptable, then the length of the frangible indicator member 43 will be approximately six inches, such that any elongation of the sling 14 beyond six inches results in permanent breakage of the frangible indicator member 43.

A first sleeve-like jacket member 44 encircles the first web member 41, the lifting sling cover 14 and the load bearing core 11, and is affixed to the lifting sling cover 14 and load bearing core 11 by suitable fastener means 24, such as by stitching. The first jacket member 44 is sized so as to terminate without covering the frangible indicator member 43. A second sleeve-like jacket member 45 encircles the second web member 42, the frangible indicator 43, the lifting sling cover 14 and the load bearing core 11, and is affixed only to the second web member 42 at or near the end of the second web member 42 connected to the frangible indicator member 43. The second jacket member 42 covers the frangible indicator 43 and overlaps, or is overlapped by, the first jacket member 44 in the passive and acceptable load bearing condition, as shown in FIGS. 5 and 6.

In the event the load exceeds the sling safe load value, the sling cover 14 and core 11 elongate excessively, the slack in the frangible indicator member 43 is taken up and the frangible indicator member 43 breaks, and the second jacket 45 and the first jacket 44 are pulled apart to expose the warning marker 46 to the operator. When the load is removed, the second jacket 45 will again cover the warning marker 46, but the broken frangible indicator member 43 will show upon inspection that the safe load value for the sling 14 has been exceeded and therefore the sling 14 should not be re-used. Thus, this embodiment provides both a real-time and a permanent indication of overload.

It is understood that equivalents and substitutions to certain elements set forth above may be obvious to those skilled in the art, and therefore the true scope and definition of the invention is to be as set forth in the following claims.

I claim:

1. A lifting sling comprising a load bearing core, a cover and excessive elongation warning indicator means, wherein said load bearing core and said cover elongate under load;

said excessive elongation warning indicator means comprising a non-elongating body attached to said cover, wherein said non-elongating body is non-load bearing, and warning markings disposed on said cover, said non-elongating body further comprising demarcation means to indicate in combination with said warning markings the extent of elongation of said sling;

wherein said non-elongating body comprises a member attached to said cover.

2. The sling of claim 1, wherein said demarcation means comprises a window disposed in said non-elongating body.

3. The sling of claim 2, wherein said warning markings are chosen from the group of warning markings consisting of differing shapes, differing colors, words and numbers.

4. The sling of claim 1, wherein said non-elongating body is tubular.

5. The sling of claim 1, wherein said warning markings are chosen from the group of warning markings consisting of differing shapes, differing colors, words and numbers.

6. A lifting sling comprising a dynamic load bearing core, a dynamic cover and excessive elongation warning indicator means;

said excessive elongation warning indicator means comprising a static non-elongating body attached to said cover, wherein said non-elongating body is non-load bearing, and warning markings disposed on said cover, said static non-elongating body further comprising demarcation means to indicate in combination with said warning markings the extent of elongation of said sling;

wherein said static non-elongating body comprises a member attached to said dynamic cover.

7. The sling of claim 6, wherein said demarcation means comprises a window disposed in said static non-elongating body.

8. The sling of claim 7, wherein said warning markings are chosen from the group of warning markings consisting of differing shapes, differing colors, words and numbers.

9. The sling of claim 6, wherein said static non-elongating body is tubular.

10. The sling of claim 6, wherein said warning markings are chosen from the group of warning markings consisting of differing shapes, differing colors, words and, numbers.

11. A lifting sling comprising a load bearing core, a cover and excessive elongation warning indicator means, wherein said load bearing core and said cover elongate under load;

said excessive elongation warning indicator means comprising a warning marking disposed on said cover, a frangible indicator member extending across said warning marking and affixed to a first web member and a second web member, said first and second web members being affixed to said cover, and a jacket member covering said frangible indicator member and said warning marking, said jacket member being affixed to said second web member;

whereby upon excessive elongation of said lifting sling, said frangible indicator member breaks and said jacket member moves to expose said warning marking.

12. The sling of claim 11, wherein said jacket member is a second jacket member and said excessive elongation warning indicator means further comprises a first jacket member, said first jacket member being affixed to said cover and covering at least a portion of said first web member.

13. The sling of claim 12, wherein said frangible indicator member, said first and second web members, and said first and second jacket members are affixed using stitching.

14. The sling of claim 12, wherein said frangible indicator member is a wire.

15. The sling of claim 12, wherein said frangible indicator member is a cable.

16. The sling of claim 12, wherein said first and said second jacket member overlap prior to excessive elongation.

17. The sling of claim 11, wherein said frangible indicator member is a wire.

18. The sling of claim 11, wherein said frangible indicator member is a cable.

19. The sling of claim 11, wherein said frangible indicator member, said first and second web members, and said jacket member are affixed using stitching.

* * * * *